United States Patent [19]

Vollbrecht et al.

[11] 4,212,915

[45] Jul. 15, 1980

[54] MAT MATERIAL OF MELT-SPUN POLYMERIC FILAMENTS HAVING DISCONTINUOUS CAVITIES

[75] Inventors: Rolf Vollbrecht, Obernburg; Karl Ostertag, Erlenbach, both of Fed. Rep. of Germany

[73] Assignee: Akzona Incorporated, Asheville, N.C.

[21] Appl. No.: 921,715

[22] Filed: Jul. 3, 1978

Related U.S. Application Data

[63] Continuation of Ser. No. 738,985, Nov. 4, 1976, abandoned.

[30] Foreign Application Priority Data

Nov. 7, 1975 [DE] Fed. Rep. of Germany ..... 2550070

[51] Int. Cl.[2] ..... D04H 1/58

[52] U.S. Cl. ..... 428/288; 264/45.8; 428/296; 428/297; 428/307; 428/308; 428/398

[58] Field of Search ..... 428/288, 296, 297, 304, 428/308, 310, 317, 364, 394, 397, 398, 307, 373; 264/41, 47, 177 F, 45.8

[56] References Cited

U.S. PATENT DOCUMENTS

| | | | |
|---|---|---|---|
| 3,576,931 | 4/1971 | Chopra et al. | 264/177 F |
| 3,684,647 | 8/1972 | Matsui et al. | 264/177 F |
| 3,700,544 | 10/1972 | Matsui | 264/177 F |
| 3,706,828 | 12/1972 | Izentes | 264/177 F |
| 3,725,192 | 4/1973 | Ando et al. | 264/177 F |
| 4,045,352 | 8/1977 | Rembaum et al. | 264/41 |
| 4,051,300 | 9/1977 | Klein et al. | 264/177 F |
| 4,054,709 | 10/1977 | Belitsin et al. | 264/177 F |

*Primary Examiner*—James J. Bell

*Attorney, Agent, or Firm*—Francis W. Young; Jack H. Hall

[57] ABSTRACT

A mat material suitable for use for reinforcing plastics, as an upholstery material, filter material and various other purposes is made by melt spinning a synthetic polymeric material onto a moving embossed surface where the filaments become melt fused together at mutual points of contact. A gas or gas producing substance is mixed with the melt prior to extrusion to produce a plurality of adjacent, separate, discontinuous cavities in the filament.

8 Claims, 4 Drawing Figures

MAT MATERIAL OF MELT-SPUN POLYMERIC FILAMENTS HAVING DISCONTINUOUS CAVITIES

Figures 1, 2, 3, 4:
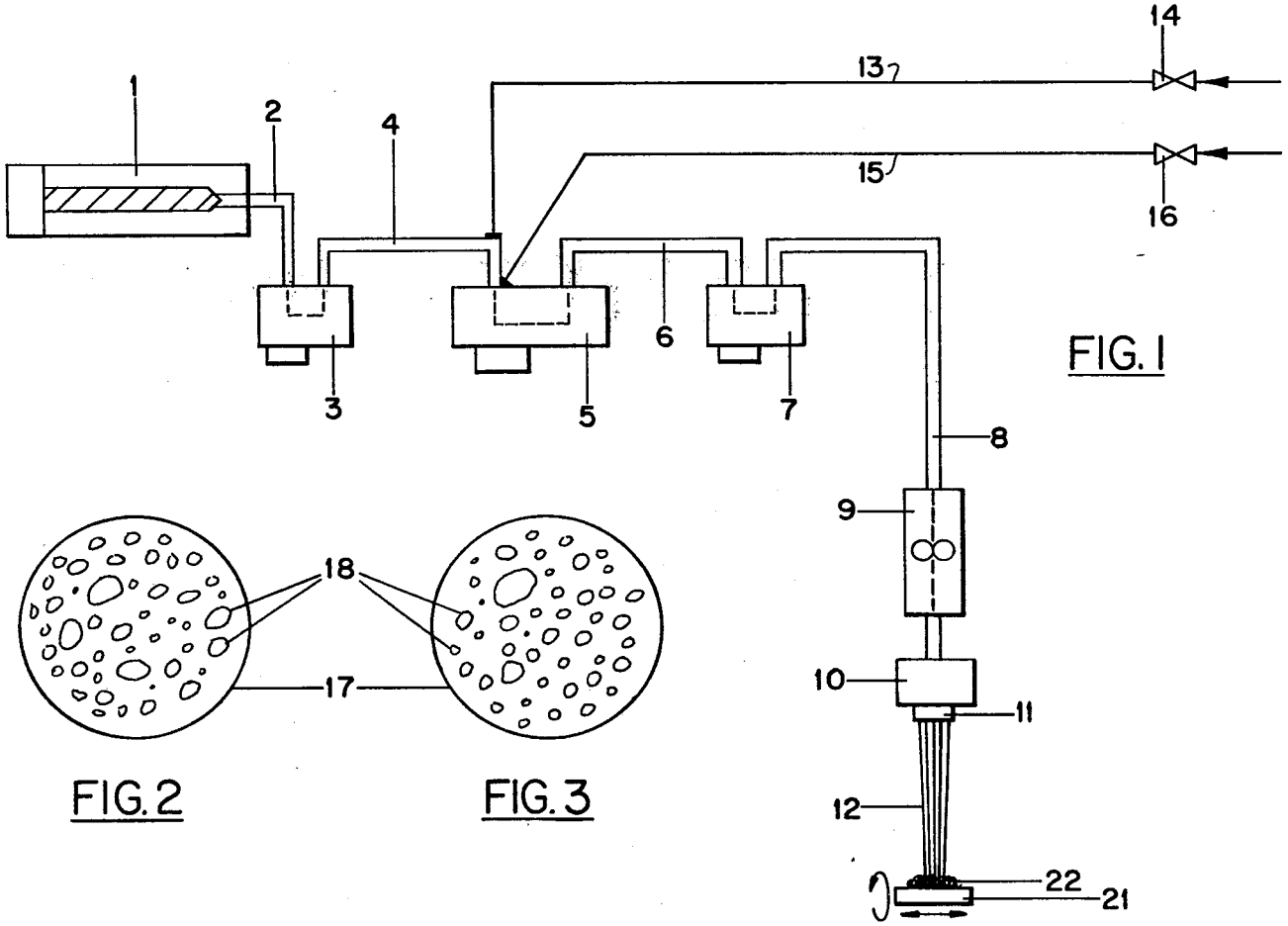

This is a continuation of application Ser. No. 738,985, filed Nov. 4, 1976, now abandoned.

This invention relates generally to melt spun polymeric filaments and, more particularly, to a mat material containing a plurality of such filaments fuse bonded together at points where they contact each other and to a process for making such a mat material.

One mat material of this general type is disclosed in GPD 1,810,921. This mat material is produced by extruding a polymer melt through a spinneret having at least three staggered rows of equally spaced spinning orifices to form a bundle of filaments onto a cooling liquid which is preferably water. The distance between spinneret face and bath surface is 2 to 30 cm, preferably 4 to 20 cm. The filaments produced by this process are deposited as loops onto the water bath. They sink into the water and fuse at mutual points of intersection, due to the inherent tackiness produced by the transition from the melted to the solid state. The resulting mat material is withdrawn from the water bath, shaken, dried and wound.

According to another process (GPD 1,922,460 and U.S. Pat. No. 3,837,988) a similar material is produced by extruding a polymer melt through several rows of spinning orifices in such a manner that the still tacky filaments drop partly onto the surface of a roller which is about half submerged in a water bath, located some 20 to 25 cm below the spinneret, and partly directly into the water bath where they are fused together. The rolls may be provided with spikes to insure continuous transport of the mat as it is forming through the water bath. To obtain a patterned web of mat material, the roller may be provided with transverse struts or other irregular elements, instead of the spikes. Mat material obtained according to this process is compacted on one side.

Another process has been described in copending U.S. Pat. application Ser. No. 703,277 filed July 7, 1976 in which a melt of a synthetic polymer is extruded from a spinneret having a plurality of spinning orifices each having a diameter in excess of about 0.2 mm, in a substantially vertical direction onto an embossed surface at a distance of 3 to 20 cm, preferably 3 to 9 cm from the spinneret. The embossed surface is moved with respect to the spinneret. The filaments are deposited onto and between the protuberances of the embossed surface and intersect one another at certain points. They become solidly fused together at these points of intersection. After cooling, the formed mat material is withdrawn from the moving surface and immediately conveyed to a winding or depositing system.

There are multiple end uses for mat materials of the type described above. They can be used to reinforce plastics, as upholstery material, as a filter mat for vertical and horizontal drainage, as a support mat for turf strips and the like, as growth mat for plants, fish, shell fish or the like, as a support mat for heavy traffic lawn areas, as soil reinforcement and erosion protection mat material, as a reinforcing mat material for embankments, dams, shorelines or the like, as fascine mat or the like, in hydraulic construction, as floor covering for stables especially cattle stables, as carpet substitutes and for many other end uses. In many of these end uses, mats of this type are mainly subjected to pressure, whereby compressibility is the decisive factor. For other end uses, for example, as embankment protection and reinforcement for dikes and shorelines, where the mat material of this type is laid out on inclined surfaces, and as required, filled with dirt, fertilizer, seeds and the like, the strength characteristics of the mat material are of primary importance. Whereas the strength characteristics of such mat material in the longitudinal direction are essentially determined by the strength of the filaments, the strength characteristics in the transverse direction are essentially determined by the strength of the adhesion or fusion sites at the intersection of the filaments. Hence, the decisive criterion for the serviceability of such mat material is, in many cases, the so-called "transverse strength", i.e., the strength measured across the direction of travel.

In numerous cases, however, a decisive role is also played by the weight of the mat material ($g/m^2$), for instance, in upholstery material, filter mats, fascine mats and carpet substitutes. For such applications, one seeks to combine a specific mat structure and a certain elasticity (recovery after load), with a minimum of mat weight. Attempts to manufacture such mat material from hollow fibers, i.e., fibers with a single, continuous cavity, or bore therethrough, meet not only with spinning difficulties, but also fail because the hollow fibers collapse after being deposited to form the mat material so that the desired effect is minimal or absent. Finally, hollow fibers have a disproportionately lower strength than fibers of solid cross-section and mats manufactured therefrom have inadequate strength in either a longitudinal or a transverse direction.

It is an object of this invention to provide a mat material of the type described made from specific synthetic polymeric filaments and which has a specific structure, definite elastic properties and favorable longitudinal and transverse strength and is devoid of the disadvantages of a mat prepared from hollow filaments. Another object of the invention is to provide a process for making the novel mat material which is free from manufacturing problems.

Other objects will become apparent from the following description with reference to the accompanying drawing wherein FIG. 1 illustrates schematically spinning apparatus suitable for making the mat material of the invention;

FIGS. 2 and 3 are illustrations in cross-section of embodiments of the filaments having a circular cross-section and a plurality of adjacent, separate, discontinuous cavities used to make the mat material of the invention; and FIG. 4 illustrates in cross-section an embodiment of a filament of the invention having a trilobal cross-section.

The foregoing objects and others are accomplished in accordance with this invention, generally speaking, by providing a mat material prepared by extruding in a substantially vertical direction filaments of a synthetic polymeric melt containing a gas onto a moving member having an embossed surface, the filaments are permitted to fuse together at mutual points of contact, cooled and removed from the moving member. Filaments of the type contemplated by the invention and a method for making them are disclosed in our copending U.S. patent application Ser. No. 738,985 filed Nov. 4, 1976, the disclosure of which is incorporated herein by reference. Such filaments contain a plurality of adjacent, individual discontinuous cavities.

The filaments of the mat material of the invention are not provided with a single, large diameter cavity or bore which extends over the entire length of the filament, but rather with a plurality of adjacent or end-to-end, approximately needle-shaped cavities, having an essentially circular cross-section and a diameter, depending on the yarn thickness and cavity constituent, of generally between 0.5μ and 6μ, but which may also reach up to 20 or more μ. The cross-section of the filaments may vary from 0.2 to 3 mm. The cavities are largely non-communicating and are enclosed by a shell.

Since all of the needle-shaped cavities are enclosed by thin polymer walls, the yarn cross-section is not markedly deformed either during the mat formation process or under extensive loading of the mat of the invention. Thus, the filaments essentially retain their shape and geometrical dimensions while the mat is used. The filaments furthermore possess a specific strength as a result of which the longitudinal and transverse strengths of the mat are distinctly higher than if made from hollow filaments. The filaments contain preferably up to 1 weight %, most preferably 0.1 to 0.4 weight %, based on the weight of the melt, of a silicone oil. This leads to a substantial improvement in the spinnability of the polymer, increases the running time of the spinnerets and provides mainly for a uniform distribution of the cavities in the filaments.

Any suitable fiber-forming, melt-spinnable polymer may be used for making the filaments of the invention. For example, nylon 66, copolymers of nylon 6 and nylon 66 or polyethylene terephthalate, polypropylene or other polyolefins may be used.

The number and size of the cavities, essential to the invention, are preferably selected so as to insure that the cavities in every filament represent between 20 and 80 volume percent, preferably 40 to 70 volume percent, based on the total volume enclosed by the outer shell of the filament. With a very high cavity constituent, isolated cavities at the surface of the filament may burst or split open, conferring to the filament an interesting surface structure, which is of particular interest when the mat of the invention is intended for reinforcement of plastics, rubber, bitumen, plaster or other setting or curing substances.

The mat material of the invention can be manufactured in a conventional manner, whereby the melt, before extruding, contains a finely divided cavity-forming substance, for example, a gas or a gas-forming substance, in dispersed or dissolved form. Processes using no cooling bath in spinning, for example, that described in U.S. patent application Ser. No. 703,277 filed July 7, 1976 are especially suitable.

A particularly advantageous process for the manufacture of a mat in accordance with this invention involves the extrusion of a melt of a synthetic polymer through a spinneret having a plurality of spinning orifices, each orifice having a diameter larger than about 0.2 mm, onto a moving surface at a distance from the spinneret, which process is characterized according to the invention in that the melt is mixed before extrusion with a gas or gas-forming substance that is essentially inert with respect to the melt, under conditions whereby the gas or gas-forming substance is largely dissolved or finely dispersed in the melt, and is spun in an essentially vertical direction, onto a moving plane having a structured surface, located at a distance of 3 to 20 cm from the spinneret, on which surface the filaments are deposited onto and between the elements forming the surface structure of the plane where they are solidly fused together at intersection sites, the resulting mat material after cooling is withdrawn from the moving plane, and immediately fed to a winding or depositing system.

Before extrusion, it is preferable to mix a silicone oil with the melt, which silicone oil is generally added in quantities of up to 1 weight %, based on the weight of the melt, preferably of less than 0.4 weight %.

The gases or gas-forming substance and the silicone oil are added most expediently between a pressure pump located behind the melting unit and a metering or spinning pump preceding the spinning head, whereby the melt pressure lies preferably between 50 and 200 bar, especially between 80 and 160 bar.

Any suitable silicone oil may be used. Those commercially available and having a viscosity of 30 to 400 cP (at 20° C.) were found especially suitable to carry out the process of the invention. Particularly suitable are unstabilized silicone oils of a viscosity of 3 to 50 cP (at 20° C.); silicone oil of higher viscosity must be expediently stabilized with known stabilizers, for example, with cerium compounds.

The silicone oils may also contain conventional nucleating agents such as finely grained titanium dioxide, kaolin, talc, and the like.

The quantity of gas mixed with the melt may be varied within relatively wide limits. Care should be taken, however, that mixing of the gas with the melt is performed under conditions whereby the gas is largely dissolved or finely dispersed in the melt. Melt conditions which are important are temperature and pressure. The density of the resulting filaments is reduced by increasing the addition of gas. It is thus possible to vary the density of the resulting filaments within relatively wide limits by controlling the volume of gas added to the melt. The quantity of added gases may be varied, for example, by modification of the pressure, at which the gas is injected into the melt, by variation of pressure or detention time of the melt at the gas injection point.

Any suitable gas which is substantially inert to the melt may be used. For example, carbon dioxide, nitrogen, argon or the like may be used.

The density of the resulting filaments can be varied by using different gases.

Another possibility to vary the density of the filament is by using as inert gas a mixture of two or more gases, whereby the proportions of individual gases in the gas mixture are varied. Thus, specific densities can be obtained very simply by maintaining constant all other conditions such as pressure, temperaure, throughput, detention time in the mixer, etc., with variation only of one of the gas constituents in the added gas mixture. For example, suitable densities can be very advantageously obtained by using mixtures of carbon dioxide and nitrogen. It is also possible to inject two or more gases at spaced points.

Organic solvents are especially suitable gas-forming substances. As the melt emerges from the spinneret, the solvents, like the added gas, form in the filaments the cavities essential to the invention. Gas-forming substances to be considered in this context include among others low-boiling hydrocarbons such as pentane or hexane, hydrocarbons which are gaseous at room temperature, such as butane, and halogenated paraffins, especially fluorohydrocarbons, such as tetrachlorofluoroethane and the like.

Spinning conditions are essentially identical to those employed in conventional spinning of the melt without cavity-forming substances. Consequently, with the exception of the added supply lines for silicone oil and gas-forming substance, as well as an additional mixer, conventional spinning equipment can be used.

The filaments used to manufacture the mat of the invention may have a circular cross-section or any other suitable crosssection, without creating special spinning problems.

The structured surface onto which the filaments are extruded may be a roller, a drum or a conveyor belt, whereby this surface is preferably provided with protuberances of a density of 3 to 150, preferably 10 to 50 protuberances per square decimeter. The distance from the spinneret is then measured from the top of the protuberance. The height of the protuberance determines the thickness of the mat material. It may reach, for example, 2 to 100 mm, depending on the end use of the mat material. Protuberances of about 5 to 70 mm are preferable. The protuberances may assume the shape of truncated cones, truncated pyramids, nails with more or less pronounced heads, screws or other optionally shaped elements, secured to the surface of the roller, drum, conveyor belt or the like. Their mutual spacing should be sufficient for the filaments between the protuberances to be able to hang down onto the surface of the roller, drum, etc., and there to provide sites for fusion. A suitable embossed profile can also be obtained on the roller, drum, conveyor belt, etc., by providing a coating thereon which has a network of V-shaped grooves produced by milling or the like. The preferred embossed profile of rectangular, truncated pyramids is easily obtained in this manner. The mat material obtained therewith exhibits a waffle-like structure.

The structured surface can also be provided with a coating having spaced grooves running transversally or obliquely to the draw-off direction of the mat material.

The transverse strength of the mat material of the invention can be substantially increased when the moving surface assumes a traversing motion across the travel direction of the mat. The traverse motion has preferably an amplitude of about 3 to 10 mm and a frequency of about 80 to 300 per minute.

Referring now to the drawing, the spinning unit shown in FIG. 1 contains, like conventional spinning equipment, standard elements including a melting device 1, here in the form of an extruder, but which could also be a melting grid, a first pressure pump 3, a second pressure pump 7 and a spinning head 10, with a spinneret 11. Preceding spinning head 10, there may be an additional, likewise conventional, metering or spinning pump 9.

To carry out the process according to the invention, additional lines 13, 15 with regulating devices 14, 16 are required to feed an inert gas or an inert gas-forming substance and the silicone oil to the melt. Feeding of the silicone oil, inasmuch as a single screw extruder is used, is more expediently accomplished after the extruder pressure has built up, since especially when adding more than about 0.1 weight % silicone oil the transporation effect of the screw declines. The silicone oil is advantageously added between the extruder and pressure pump 7 or spinning pump 9 located before spinning head 10. Conversely, the inert gas or inert gas-forming substance should preferably be added between two pressure locks acting on melting device 1 and spinning head 10. In the example shown in FIG. 1 pressure pump 3 or 7 acts as a pressure lock with respect to melting device 1 and spinning head 10, so that the inert gas or the inert, gas-forming substance is added preferably between these two pressure pumps 3 and 7.

To insure a maximum of homogeneity in mixing the gas or gas-forming substance and silicone oil (the sequence of addition is in principle immaterial) with the melt, a mixer 5 is also required. The latter is preferably located between the two pressure pumps 3, 7, whereby lines 13, 15 may lead into melt line 4 located between pressure pump 3 and mixer 5 or immediately into mixer 5.

In the embodiment of the apparatus shown in FIG. 1, the process of the invention may be carried out approximately as follows:

Polymer chips such as chips of nylon 66 are melted in melting device 1, a conventional single screw extruder in this case. The melt at a pressure of, for example, about 70 bar travels via the first pressure pump 3 where its pressure is brought to about 40 to 80 bar, to melt line 4. By means of regulating unit 14, for example, a piston metering pump operating at very low throughput, the required quantity of silicone oil is introduced via line 13 into melt line 4, and via line 15, for example, gaseous nitrogen is added, whose pressure and volume is regulated via regulating unit 16. The gas is introduced under pressure and temperature conditions, whereby it is largely dissolved or dispersed in the melt. The mix composed of melt, silicone oil and gas or gas-forming substance is extensively homogenized in mixer 5, which is, for example, a pin mixer operating at 150 to 200 rpm, or a static mixer composed of about 20 to 30 mixer elements, and transported via melt line 6 to the second pressure pump 7. From there, the melt including the components that are dissolved or mixed in it is led via melt line 8 and, as the case may be, via a metering or spinning pump 9 to spinning head 10. Filaments 12 emerge from spinneret 11 and because of the pressure reduction occurring on emergence from the spinneret, contain a plurality of spherical gas inclusions, essentially uniformly distributed over the yarn cross section and yarn length. As a result of the spinning stretch of the filaments, these cavities assume a needle shape.

Filaments 12 are laid down, undrawn, on a moving plane surface 21, here a conveyor belt, which executes a traverse motion, preferably across the direction of transport, and forms thereon the mat material of the invention.

It is obvious that a melt line 8 behind the second pressure pump 7 or behind the metering or spinning pump 9 can be branched in a known manner, i.e., that the melt mixed with silicone oil and gas or gas-forming substance can be supplied from a central mixer 5 via distribution lines, not only to one spinning head, but simultaneously to a number of spinning heads.

It is also possible, instead of the central mixer, to use individual spinning heads (not shown), each provided with an individual small mixer, which insures that before the melt reaches the spinning head, the gas or gas-forming substance and silicone oil are homogeneously distributed within the melt. A novel chain mixer, as described in Ger. Patent Application No. P 25 50 069.0 filed Nov. 7, 1975, which mixer can be combined with the spinning pump is eminently suitable for this.

Examples of the filaments used according to the invention are illustrated in FIGS. 2, 3 and 4 of the enclosed drawing. FIGS. 2 and 3 illustrate filaments 17, of essentially circular cross-section. These schematic drawings of an individual filament (sections obtained at intervals of a few centimeters) indicate that in contrast to the state-of-the-art, the filaments have a cross-section closely resembling the profile of the spinneret's orifice, and above all, an essentially whole outer covering, whereby the needle-shaped cavities 18 are uniformly distributed over the cross-section. The cross-sections of cavities 18 are essentially circular.

As shown in FIG. 4, in addition to filaments having a circular cross-section, mat material made from filaments of different cross-sections, e.g., rectangular, square, pentagonal or polygonal, oval, trilobal or multilobal, can be obtained according to the invention. The example illustrates a single filament 19 of trilobal cross-section, again containing a plurality of separate, needle-shaped cavities 20, of essentially circular cross-section.

Although the invention is described in detail for the purpose of illustration, it is to be understood that such detail is solely for that purpose and variations can be made therein by those skilled in the art without departing from the spirit and scope of the invention except as it may be limited by the claims.

What is claimed is:

1. A mat material containing non-woven melt-spun polymeric filaments of which at least some intersect each other and are fused together at least at some of the points of intersection, said filaments having a diameter of from 0.2 to 3 mm. and a plurality of adjacent, separate, uniform, discontinuous cavities enclosed in an external shell, said cavities comprising hollow spaces having between 20 and 80 volume % of each filament.

2. The mat material of claim 1 wherein the filaments contain up to 1 weight %, based on the weight of the melt, of a silicone oil.

3. The mat material of claim 2 wherein the filaments are composed of polycaprolactam and contain 0.2 to 0.4 weight % based on the weight of the melt, of a silicone oil.

4. The mat of claim 2 wherein the filaments are composed of polyethylene terephthalate, and contain 0.1 to 0.3 weight %, based on the weight of the melt, of a silicone oil.

5. A mat comprising melt spun non-woven polymeric filaments which contain a plurality of substantially non-communicating hollow spaces separated by polymeric walls which resist compression of the filament under load, said filaments having a cross section of from about 0.2 to about 3 millimeters and being fuse bonded together at mutual points of contact, and from about 20 to about 80% of the total volume of the filament being occupied by hollow spaces comprising adjacent, separate, uniform, discontinuous, needle-shaped cavities enclosed in an external shell.

6. The mat material of claim 2 wherein the filaments contain from about 0.1 to about 0.4 weight % of a silicone oil based on the weight of the melt.

7. The mat material of claim 1 wherein the cavities in each filament make up between 40 and 70 volume % of the filament, based on the total volume enclosed within the outer shell of the filament.

8. The mat of claim 5 wherein the cavities in each filament make up between 40 and 70 volume % of the filament, based on the total volume enclosed within the outer shell of the filament.

* * * * *

UNITED STATES PATENT OFFICE

CERTIFICATE OF CORRECTION

Patent No. 4,212,915 Dated July 15, 1980

Inventor(s) Rolf Vollbrecht and Karl Ostertag

It is certified that error appears in the above-identified patent and that said Letters Patent are hereby corrected as shown below:

Under the heading "Related U.S. Application Data" correct the serial number of the parent application to --738,986--.

Signed and Sealed this

*Twentieth* Day of *January 1981*

[SEAL]

*Attest:*

RENE D. TEGTMEYER

*Attesting Officer*

*Acting Commissioner of Patents and Trademarks*